US010932058B2

(12) United States Patent
Xiao et al.

(10) Patent No.: US 10,932,058 B2
(45) Date of Patent: Feb. 23, 2021

(54) SPEAKER

(71) Applicant: AAC Technologies Pte. Ltd., Singapore (SG)

(72) Inventors: Bo Xiao, Shenzhen (CN); Ronglin Linghu, Shenzhen (CN); Xiaodong Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/702,591

(22) Filed: Dec. 4, 2019

(65) Prior Publication Data

US 2020/0213752 A1 Jul. 2, 2020

(30) Foreign Application Priority Data

Dec. 31, 2018 (CN) ..... 201822279226.6

(51) Int. Cl.

| | |
|---|---|
| ***H04R 9/06*** | (2006.01) |
| ***H04R 7/12*** | (2006.01) |
| ***H04R 9/02*** | (2006.01) |
| ***H04R 7/18*** | (2006.01) |
| ***H04R 9/04*** | (2006.01) |
| ***H04R 7/20*** | (2006.01) |

(52) U.S. Cl.

CPC ..... *H04R 9/06* (2013.01); *H04R 7/12* (2013.01); *H04R 7/18* (2013.01); *H04R 7/20* (2013.01); *H04R 9/025* (2013.01); *H04R 9/041* (2013.01); *H04R 9/043* (2013.01); *H04R 2499/11* (2013.01)

(58) Field of Classification Search

CPC . H04R 7/12; H04R 7/122; H04R 7/18; H04R 7/20; H04R 9/025; H04R 9/041; H04R 9/043; H04R 9/045; H04R 9/06; H04R 2400/11; H04R 2499/11

See application file for complete search history.

(56) References Cited

U.S. PATENT DOCUMENTS

| | | | | |
|---|---|---|---|---|
| 8,995,704 | B2 * | 3/2015 | Huang | H04R 9/043 381/404 |
| 2016/0173990 | A1 * | 6/2016 | Park | H04R 1/06 381/354 |
| 2018/0302722 | A1 * | 10/2018 | Linghu | H04R 7/18 |

* cited by examiner

*Primary Examiner* — Huyen D Le
(74) *Attorney, Agent, or Firm* — W&G Law Group LLP

(57) ABSTRACT

A speaker includes a holder having a receiving space, a magnetic circuit unit and a vibration unit. The vibration unit includes a diaphragm, a voice coil driving the diaphragm to vibrate, and a centering support member. The centering support member includes a connecting portion between the upper diaphragm and the voice coil, extension portions extending from two ends of the connecting portion and towards the magnetic circuit unit, and body portions each formed by extending from an tail end of each extension portion while being bent in a direction facing away from the extension portion. The connecting portion is interposed between the diaphragm and the voice coil. The extension portion is located between the magnetic circuit unit and the holder. An end the body portion is connected to the holder, and the other end is connected to the voice coil to support the voice coil.

7 Claims, 5 Drawing Sheets

A-A

SPEAKER

TECHNICAL FIELD

The present disclosure relates to the technical field of electronic apparatus, and in particular, to a speaker.

BACKGROUND

With an advent of a mobile internet era, more and more smart mobile devices emerge. Among numerous mobile devices, mobile phones are undoubtedly the most common and portable mobile terminal devices. At present, the mobile phones have various functions, one of which is a high-quality music displaying. Therefore, a speaker in the mobile phone is one of necessary components for realizing the function of high-quality music displaying. Design of a structure of the speaker, which is a voice displaying device, directly affects a voice quality.

The speaker known in the related art includes a sounding diaphragm and a voice coil configured to drive the sounding diaphragm to vibrate and sound. Conventional micro-speakers mostly have a design of single sounding diaphragm, and thus the voice coil is prone to sway during a vibration process, thereby affecting motion stability of a vibration unit and affecting sound quality. In addition, a dome and a centering support piece known in the related art are two different parts and need to be separately assembled.

Therefore, it is urgent to provide a new speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
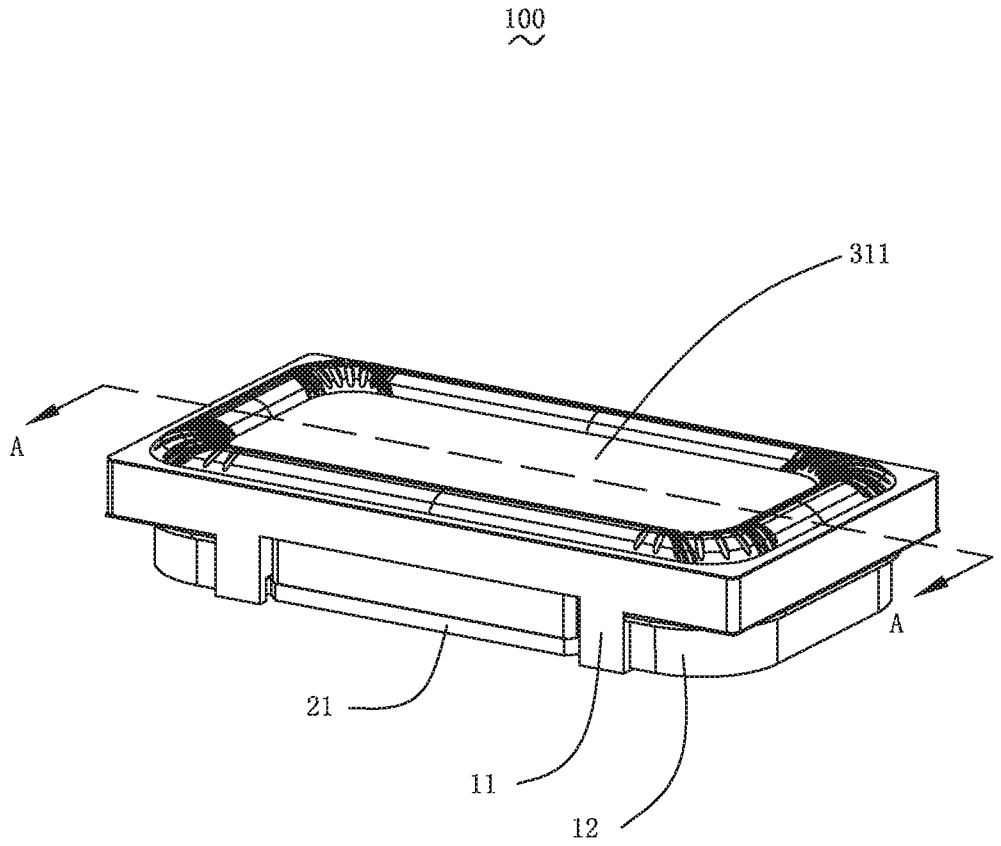
FIG. 1 is a structural diagram of a speaker provided by the present disclosure.
Figure 2:
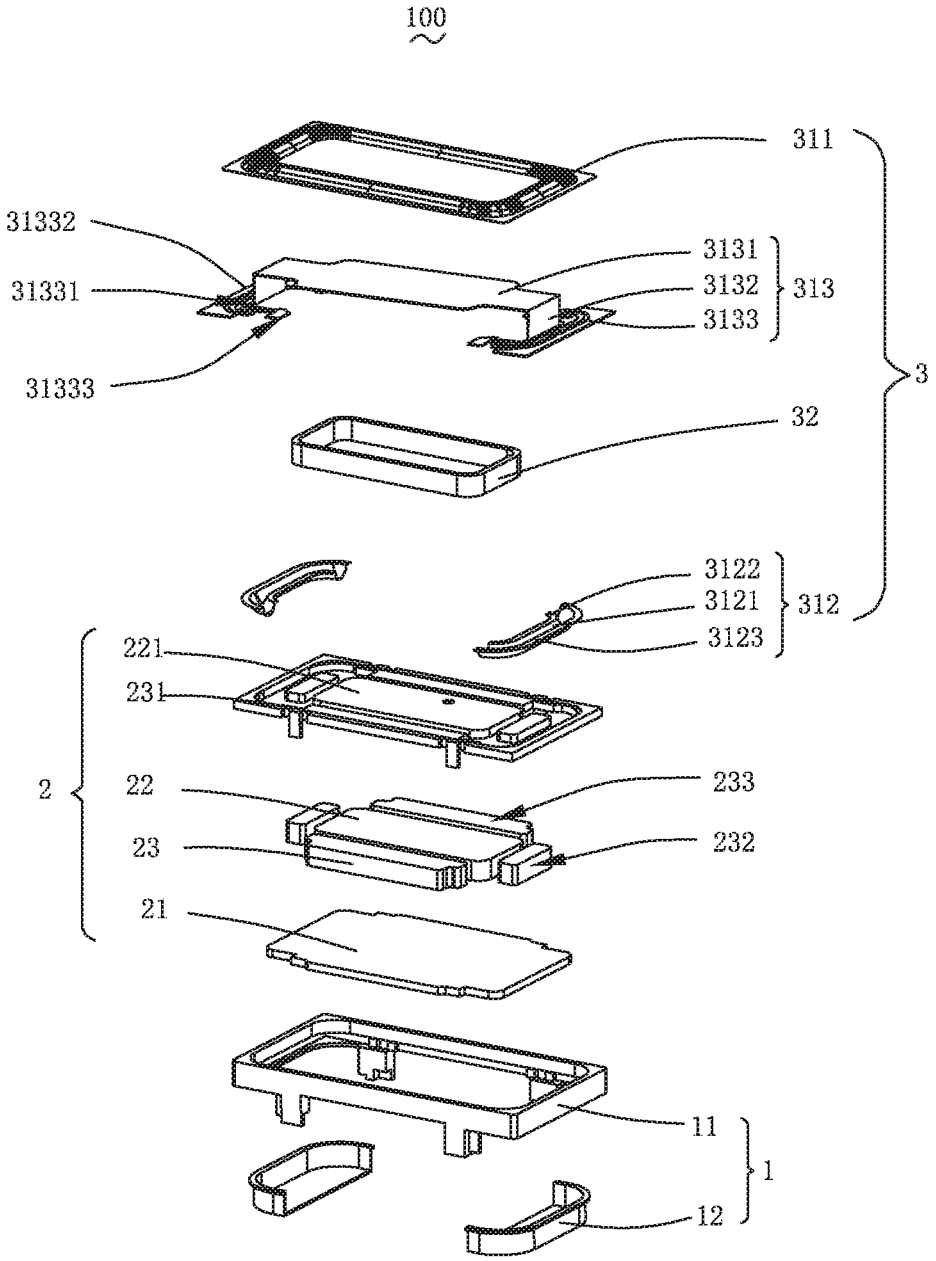
FIG. 2 is an exploded view of a speaker provided by the present disclosure.
Figure 3:
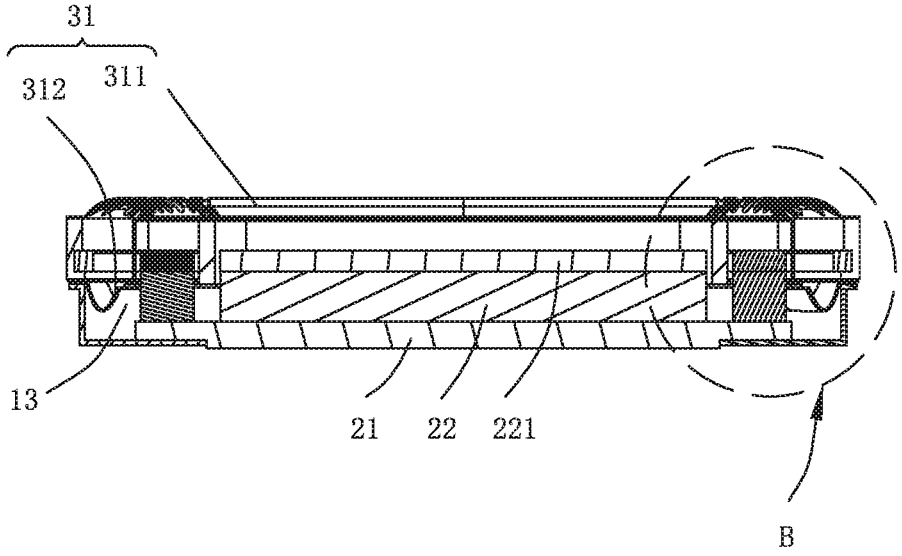
FIG. 3 is a cross-sectional view taken along line A-A of FIG. 1.
Figure 4:
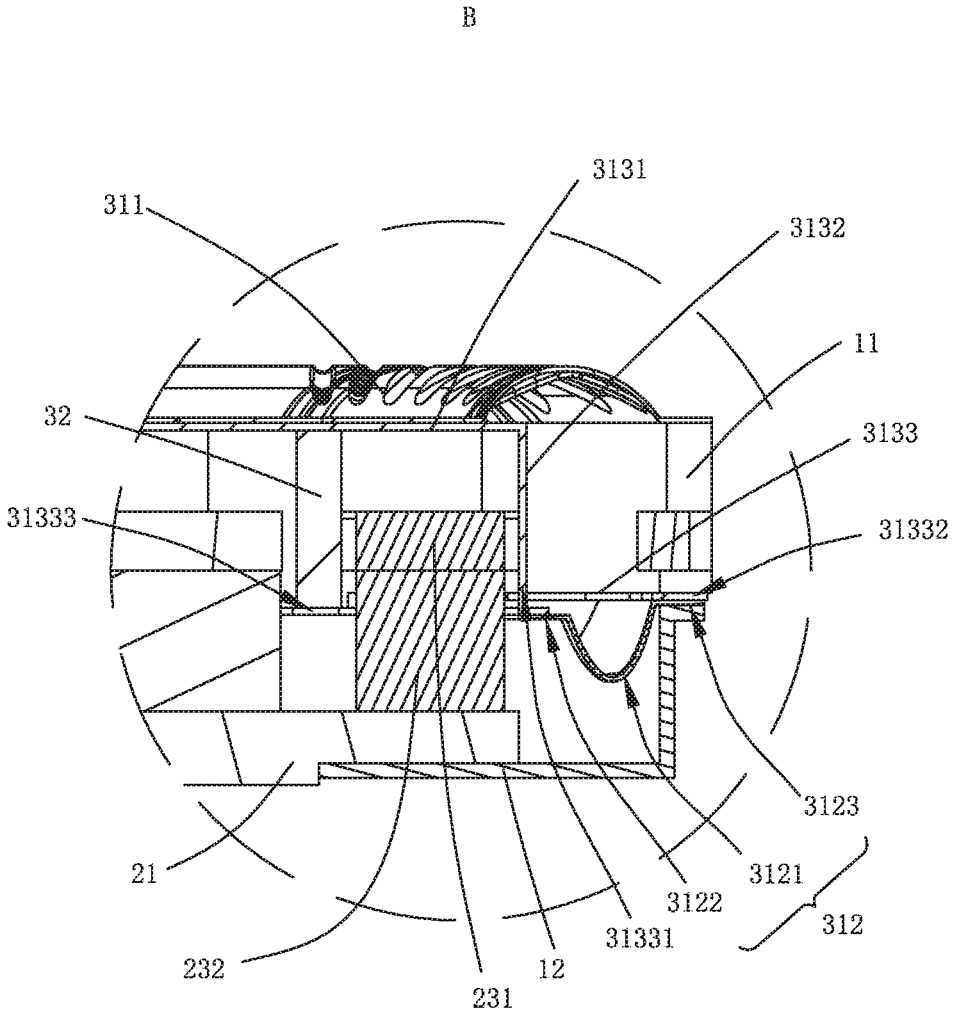
FIG. 4 is an enlarged view of a position B shown in FIG. 3.
Figure 5:
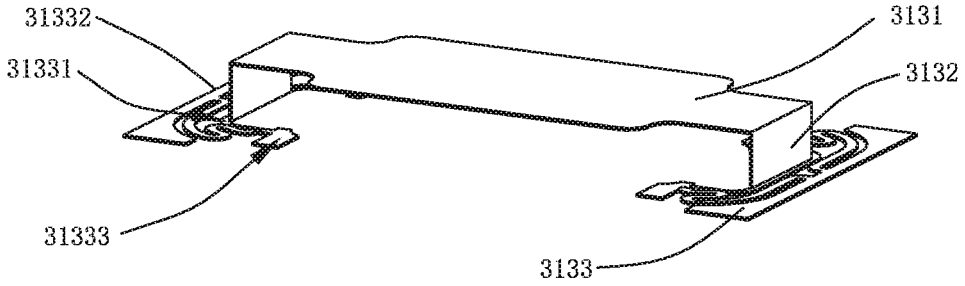
FIG. 5 is a structural diagram of a centering support member provided by the present disclosure.

Referring to FIG. 1 and FIG. 2, the present disclosure provides a speaker 100. The speaker 100 includes a holder 1 having a receiving space, a magnetic circuit unit 2 and a vibration unit 3 that are fixed to the holder 1 and received in the receiving space.

The magnetic circuit unit 2 includes a yoke 21, a main magnet 22 fixed to the yoke 21, an auxiliary magnet 23 surrounding the main magnet 22, a main pole plate 221 attached to the main magnet 22, and an auxiliary pole plate 231 attached to the auxiliary magnet 23.

The auxiliary magnet 23 can be a monolithic annular magnet, or a plurality of strip-shaped magnets provided around the main magnet 22. In the present embodiment, the auxiliary magnets 23 includes four strip-shaped magnets, and the four strip-shaped magnets are disposed around the main magnet 22 and are central symmetrical to each other.

The main pole plate 221 and the auxiliary pole plate 231 are made of a magnetic material, which exerts magnetic conduction effect, converges magnetic fields and improves the magnetic induction performance of the device. The auxiliary pole plate 231 can be an annular pole plate or a strip-shaped pole plate. In the present embodiment, the auxiliary pole plate 231 is composed of two strip-shaped pole plates and one annular pole plate that are attached to the four auxiliary magnets 23, respectively.

The holder 1 includes a main holder 11 and an auxiliary holder 12 connecting the main holder 11 and the yoke 21, and the auxiliary holder 12 is provided under the main holder 11.

The vibration unit 3 includes a diaphragm 31, and a voice coil 32 configured to drive the diaphragm 31 to vibrate. The diaphragm 31 includes an upper diaphragm 311 fixedly connected above the main holder 11, and a lower diaphragm 312 opposite to and spaced apart from the upper diaphragm 311.

Referring to FIG. 2 to FIG. 5, the vibration unit 3 further includes a centering support member 313. The centering support member 313 includes a connecting portion 3131, extension portions 3132 extending from two opposite ends of the connecting portion 3131 towards the lower diaphragm 312, and body portions 3133 each formed extending from a tail end of one of the extension portions 3132 while being bent in a direction facing away from the extension portion 3132. In an embodiment, the extension portion 3132 and the connecting portion 3131, as well as the extension portion 3132 and the body portion 3133 enclose a right angle, respectively. In some embodiments, an elastic portion 31331 is in a bending shape capable of providing elastic force.

The centering support member 313 connects the upper diaphragm 311 with the lower diaphragm 312.

In an embodiment, the connecting portion 3131 is fixedly connected to the upper diaphragm 311, and the connecting portion 3131 is interposed between the upper diaphragm 311 and the voice coil 32. In an embodiment, the connecting portion 3131 is fixedly adhered to the upper diaphragm 311 and the voice coil 32, respectively. The connecting portion 3131 is fixedly adhered to a middle portion of the upper diaphragm 311, such that the connecting portion 3131 replaces a dome, such that assembly procedures and materials are reduced, thereby saving the cost and improving efficiency.

In an embodiment, the auxiliary magnet 23 includes a first auxiliary magnet 232 extending along a long axis direction of the main magnet 22 and a second auxiliary magnet 233 extending along a short axis direction of the main magnet 22. A first gap 13 is formed between the first auxiliary magnet 232 and the holder 1, and the extension portion 3132 is located in the first gap 13. In this way, such a structure allows the extension portion 3132 to form an avoiding portion for the first auxiliary magnet 232.

In an embodiment, the lower diaphragm 312 is fixedly connected below the body portion 3133. The body portion

3133 includes a first fixing portion 31332 fixedly connected to the holder 1, a support portion 31333 fixedly connected to an end of the voice coil 32 facing away from the upper diaphragm 311, and an elastic portion 31331 connecting the first fixing portion 31332 with the support portion 31333. The lower diaphragm 312 includes a suspension portion 3121, an intermediate portion 3122 provided at an inner side the suspension portion 3121 and a second fixing portion 3123 provided an outer side the suspension portion 3121.

One end of the lower diaphragm 312 is interposed between the holder 1 and the first fixing portion 31332, and the other end thereof is connected to the elastic portion 31331. The second fixing portion is fixedly connected to the first fixing portion 31332. The intermediate portion 3122 is fixedly connected to the elastic portion 31331. The tail end of the extension portion 3132 is connected to the elastic portion 31331.

The speaker provided by the present disclosure adopts a stereoscopically shaped centering support member, and the centering support member has the body portion fixedly connected to the lower diaphragm, the connecting portion connected to the upper diaphragm and the extension portion inserted into the gap between the auxiliary magnet and the holder. The centering support member is connected to the upper diaphragm and the lower diaphragm to form a combined vibration unit of the upper and lower diaphragms. Compared with the related art, such a vibration unit can prohibit the sway of the speaker and improve the low-frequency performance of the speaker. In addition, the connecting portion replaces the dome, and such a structure can reduce the assembly procedures and materials, thereby saving the costs and improve efficiency.

The above described embodiments are merely intended to illustrate the present disclosure, and it should be noted that, without departing from the inventive concept of the present disclosure, the improvements made by those skilled in the related art shall fall within the protection scope of the present disclosure.

What is claimed is:

1. A speaker, comprising:

a holder having a receiving space;

a magnetic circuit unit received in the receiving space; and a vibration unit received in the receiving space, wherein the vibration unit comprises:

a diaphragm comprising an upper diaphragm fixed above the holder, and a lower diaphragm opposite to and spaced apart from the upper diaphragm and received in the receiving space;

a voice coil configured to drive the diaphragm to vibrate; and a centering support member connecting the upper diaphragm with the lower diaphragm, wherein the centering support member comprises:

a connecting portion interposed between the upper diaphragm and the voice coil;

extension portions respectively extending from two ends of the connecting portion that are opposite to each other along a long axis direction of the connecting portion, and respectively extending towards the magnetic circuit unit; and body portions each extending from a tail end of one of the extension portions while being bent in a direction facing away from the one of the extension portions, wherein the extension portions are located between the magnetic circuit unit and the holder, each of the body portions comprises a first fixing portion fixedly connected to the holder, a support portion fixedly connected to an end of the voice coil facing away from the upper diaphragm, and an elastic portion connecting the first fixing portion with the support portion, a tail end of a corresponding one of the extension portions is connected to the elastic portion, and the lower diaphragm is fixed to a side of each of the body portions facing away from the upper diaphragm.

2. The speaker as described in claim 1, wherein the lower diaphragm comprises a suspension portion, an intermediate portion provided at an inner side of the suspension portion, and a second fixing portion provided at an outer side of the suspension portion;

the second fixing portion is fixedly connected to the first fixing portion, and the intermediate portion is fixedly connected to the elastic portion.

3. The speaker as described in claim 2, wherein the holder comprises a main holder and an auxiliary holder fixedly connected below the main holder, the upper diaphragm is fixedly connected above the main holder, and the first fixing portion and the second fixing portion are interposed between the main holder and the auxiliary holder.

4. The speaker as described in claim 1, wherein the elastic portion has a bending shape for providing elastic force.

5. The speaker as described in claim 1, wherein the magnetic circuit unit comprises a main magnet and auxiliary magnets disposed on two sides of the main magnet along a long axis direction of the main magnet, and the extension portions are located between the auxiliary magnets and the holder.

6. The speaker as described in claim 1, wherein each of the extension portions and the connecting portion are disposed in a right angle, and each of the extension portions and a corresponding one of the body portions are disposed in a right angle.

7. The speaker as described in claim 1, wherein the connecting portion is fixedly adhered to the upper diaphragm and the voice coil.

* * * * *